US008042801B2

(12) United States Patent
You

(10) Patent No.: US 8,042,801 B2
(45) Date of Patent: Oct. 25, 2011

(54) IMAGE FORMING APPARATUS

(75) Inventor: Je Hwan You, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 190 days.

(21) Appl. No.: 12/508,181

(22) Filed: Jul. 23, 2009

(65) Prior Publication Data

US 2010/0090394 A1 Apr. 15, 2010

(30) Foreign Application Priority Data

Oct. 14, 2008 (KR) ..... 10-2008-0100409

(51) Int. Cl.
*B65H 1/26* (2006.01)

(52) U.S. Cl. ..... 271/157; 271/152; 271/147; 271/162

(58) Field of Classification Search ..... 271/152, 271/154, 162, 259, 157
See application file for complete search history.

(56) References Cited

U.S. PATENT DOCUMENTS 4,196,898 A * 4/1980 Misawa et al. ..... 271/9.08
4,697,803 A * 10/1987 Kan et al. ..... 271/127
5,273,272 A * 12/1993 Nakamura et al. ..... 271/167
5,480,131 A * 1/1996 Furukawa et al. ..... 271/9.06
5,897,112 A * 4/1999 Kwag ..... 271/38
5,927,707 A * 7/1999 Miura ..... 271/171
6,152,631 A * 11/2000 Park ..... 400/708
6,244,588 B1 * 6/2001 Tsubakimoto et al. ..... 271/164
6,292,636 B1 * 9/2001 Kwon ..... 399/16
7,058,353 B2 * 6/2006 Lee et al. ..... 399/393
7,878,318 B2 * 2/2011 Nunn et al. ..... 194/350
7,887,048 B2 * 2/2011 Ohno et al. ..... 271/171
2005/0236760 A1 * 10/2005 Kang ..... 271/152
2009/0129790 A1 * 5/2009 Kang ..... 399/23
2010/0074637 A1 * 3/2010 Shiraishi ..... 399/23

FOREIGN PATENT DOCUMENTS

KR 10-2005-0074218 7/2005

OTHER PUBLICATIONS

English language abstract of KR 10-2005-0074218, published Jul. 18, 2005.

* cited by examiner

*Primary Examiner* — Stefanos Karmis
*Assistant Examiner* — Howard Sanders
(74) *Attorney, Agent, or Firm* — Stanzione & Kim, LLP

(57) ABSTRACT

Disclosed herein is an image forming apparatus. The image forming apparatus can include an apparatus body, a cassette detachably mounted to the apparatus body, the cassette being configured to hold print media, and a sensor unit configured to sense whether the cassette is mounted, whether the print media are loaded, and/or whether the print media is properly positioned in the cassette.

19 Claims, 8 Drawing Sheets

IMAGE FORMING APPARATUS

CROSS-REFERENCE TO RELATED APPLICATIONS

This application claims the benefit of Korean Patent Application No. 2008-0100409, filed on Oct. 14, 2008 in the Korean Intellectual Property Office, the disclosure of which is incorporated herein by reference in its entirety.

TECHNICAL FIELD

The present disclosure relates generally to an image forming apparatus, and, more particularly, to an image forming apparatus having a sensor unit to sense whether a cassette is mounted in the apparatus, whether print media is loaded in the cassette, and/or the position of the print media in the cassette.

BACKGROUND OF RELATED ART

An image forming apparatus is an apparatus that functions to print an image on print media according to an image signal provided to the apparatus. The image forming apparatus can be, for example, a printer, a copier, a facsimile, or a multi-function device that integrates or combines some of the functions of such apparatuses.

An image forming apparatus can include an apparatus body, in which one or more components for forming an image may be housed, and a cassette to supply the print media to those components. The print media can be paper, for example, but need not be so limited. Hereinafter, print media and paper may be used interchangeably for convenience.

An image forming apparatus can include a first sensor unit that senses or detects whether the cassette is mounted in the apparatus body. An image forming apparatus can also include a second sensor unit and a third sensor unit. The second sensor unit can be configured to sense or detect whether paper is loaded in the cassette. The third sensor unit can be configured to sense or detect the position of the paper in the cassette. The cassette can include a paper loading plate that is pivotally disposed in the cassette to change the position of the paper.

The first, second, and third sensor units can each include a separate sensor. Each of these sensors can occupy a significant amount of space within the apparatus. Moreover, the possibility of malfunction of at least one aspect of the operation of the image forming apparatus may increase when such sensors do not properly operate in relation to one another.

Therefore, it may be desirable to reduce the number of sensors to minimize the space that the sensors occupy in the apparatus and/or to minimize the likelihood of a malfunction of the apparatus.

SUMMARY OF THE DISCLOSURE

In accordance with one aspect of the present disclosure, there is provided an image forming apparatus that can include an apparatus body, a cassette configured to be detachably mounted in the apparatus body and to hold print media and a sensor unit including a first actuator, a second actuator, a third actuator, a first sensor and a second sensor. The first actuator can be configured to indicate whether the cassette is mounted in the apparatus body. The second actuator can be configured to indicate whether print media is loaded in the cassette. The third actuator can be configured to indicate the position of the print media. The first sensor can be configured to detect the first actuator and the third actuator. The second sensor can be configured to detect the second actuator.

The first actuator, the second actuator, and the third actuator can be integrally formed.

The first actuator can include a first actuating arm and a first sensing arm. The first actuating arm can be configured to contact the cassette when the cassette is mounted in the apparatus body. The first sensing arm can be configured to be detected by the first sensor.

The second actuator can include a second actuating arm and a second sensing arm. The second actuating arm can be configured to contact the print media. The second sensing arm can be configured to be detected by the second sensor.

The third actuator can include the second actuating arm of the second actuator and a third sensing arm configured to be detected by the first sensor.

When no external force is applied to the first actuator, the first sensing arm and the third sensing arm are not detected by the first sensor, and the second sensing arm is not detected by the second sensor.

When the cassette is mounted in the apparatus body and the first actuating arm of the first actuator is in contact with the cassette, the first actuator is configured to rotate such that the first sensing arm of the first actuator is detected by the first sensor.

The cassette can include a loading plate configured to hold the print media and a lifting member configured to raise the loading plate. When the cassette is mounted in the apparatus body, the first sensing arm of the first actuator is detected by the first sensor, and the second sensing arm of the second actuator is not detected by the second sensor, the lifting member of the cassette can be operated to raise the loading plate.

When the loading plate is raised by the lifting member of the cassette and the second actuating arm of the second actuator contacts the print media on the loading plate, the first actuator and the second actuator can be configured to be rotated such that the first sensing arm of the first actuator is not detected by the first sensor and the second sensing arm of the second actuator is detected by the second sensor.

The lifting member of the cassette can be stopped when the first actuator, the second actuator, and the third actuator are rotated such that the first sensing arm of the first actuator is not detected by the first sensor, the second sensing arm of the second actuator is detected by the second sensor, the third sensing arm of the third actuator is detected by the first sensor, and the second actuating arm contacts the print media on the loading plate.

The first sensing arm of the first actuator can be angularly offset from the third sensing arm of the third actuator, and the second sensing arm of the second actuator can be positioned to overlap an angular gap between the first sensing arm of the first actuator and the third sensing arm of the third actuator.

The second sensing arm of the second actuator can be positioned to overlap a portion of the first sensing arm of the first actuator and a portion of the third sensing arm of the third actuator.

The cassette can include a loading plate defining an actuating hole and a lifting member configured to raise the loading plate. When the loading plate is raised to a predetermined position by the lifting member and the cassette is void of print media, the actuating hole defined by the loading plate can be such that a portion of the second actuating arm of the second actuator is inserted into the actuating hole.

When the portion of the second actuating arm is inserted into the actuating hole, the first sensing arm of the first actuator is detected by the first sensor, the second sensing arm of the second actuator is not detected by the second sensor, and the third sensing arm of the third actuator is not detected by the first sensor.

In accordance with one aspect of the present disclosure, there is provided an image forming apparatus that can include an apparatus body, a cassette detachably mounted in the apparatus body and to hold print media, a first actuator configured to detect whether the cassette is mounted in the apparatus body, a second actuator configured to detect whether print media is loaded in the cassette, a third actuator configured to detect whether the print media is positioned in the cassette, a first sensor configured to detect the first actuator and the third actuator, and a second sensor configured to detect the second actuator.

The first actuator, the second actuator, and the third actuator can each be coupled to a rotary shaft.

The first actuator can include a first actuating arm and a first sensing arm. The first actuating arm can be configured to contact the cassette when the cassette is mounted in the apparatus body. The first sensing arm can be configured to be detected by the first sensor. The second actuator can include a second actuating arm and a second sensing arm. The second actuating arm can be configured to contact the print media. The second sensing arm can be configured to be detected by the second sensor. The third actuator can include the second actuating arm of the second actuator and a third sensing arm configured to be detected by the first sensor.

The cassette can include a loading plate and a lifting member configured to raise the loading plate. The image forming apparatus can include a controller configured to control the lifting member based on the detection performed by the first sensor or the second sensor. The controller can be configured to control the lifting member to be operated when the first sensor is in a sensing state and the second sensor is in a non-sensing state, or when the first sensor is in a non-sensing state and the second sensor is in a sensing state.

The controller can be configured to control the lifting member such that the lifting member is stopped when the first sensor is in the sensing state and the second sensor is in the sensing state.

The controller can be configured to control the lifting member such that the lifting member is stopped when the second sensor remains in the non-sensing state for a predetermined time interval while the first sensor is in the sensing state.

BRIEF DESCRIPTION OF THE DRAWINGS

Various aspects and advantages of the disclosure will become apparent and more readily appreciated from the following description of the embodiments, taken in conjunction with the accompanying drawings, in which.

DETAILED DESCRIPTION OF SEVERAL EMBODIMENTS

Figure 1:
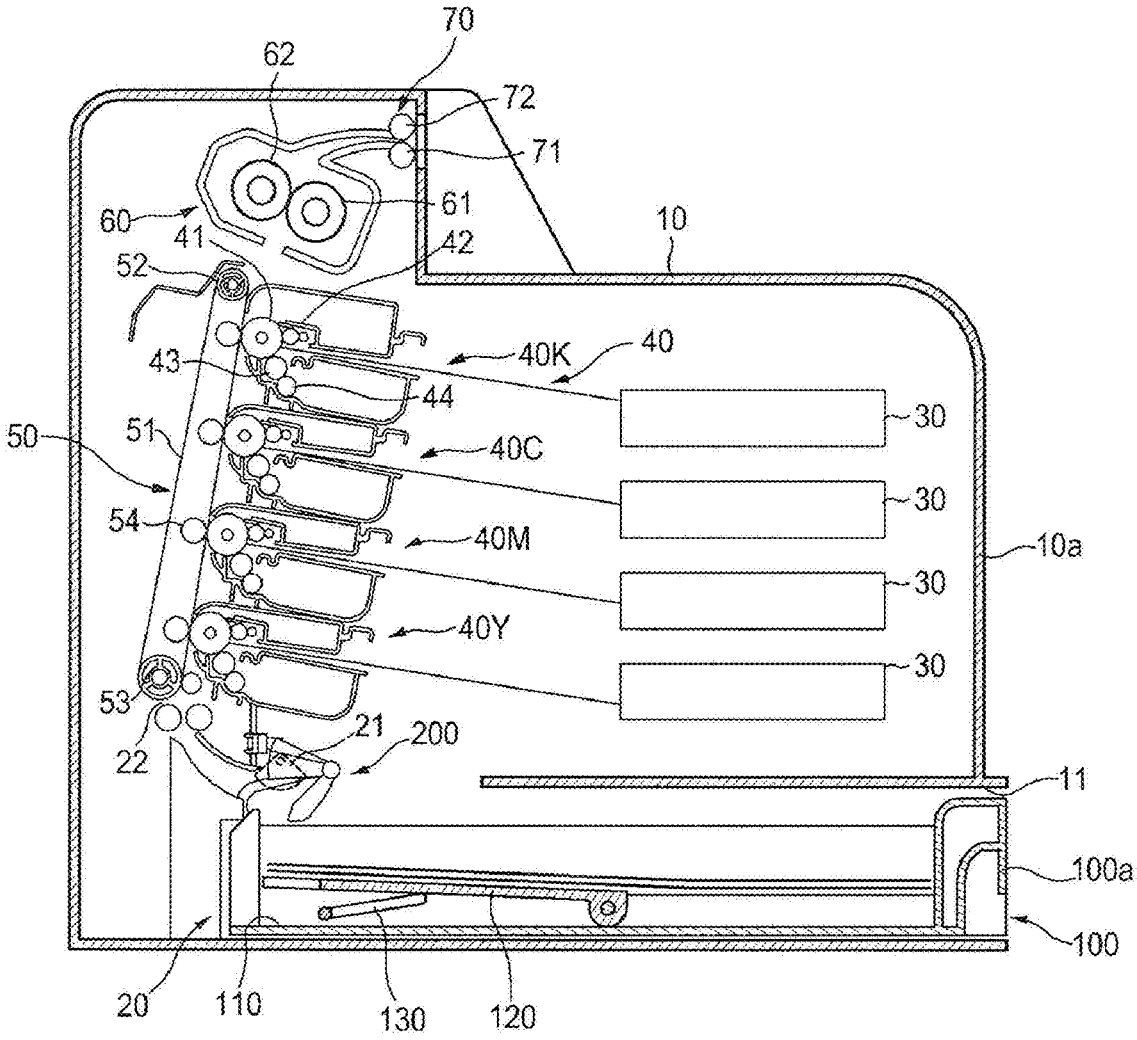
FIG. 1 is a sectional view illustrating the overall structure of an image forming apparatus according to an embodiment of the present disclosure.

Reference will now be made in detail to several embodiments of the present invention, examples of which are illustrated in the accompanying drawings, wherein like reference numerals refer to the like elements throughout.

FIG. 1 is a sectional view illustrating the overall structure of an image forming apparatus according to an embodiment of the present disclosure.

As shown in FIG. 1, the image forming apparatus can include an apparatus body 10, a paper feeding device 20, light scanning devices 30, a developer device 40, a transfer device 50, a fusing device 60, and a paper discharge device 70. The light scanning devices 30, the developer device 40, the transfer device 50, and the fusing device 60 can correspond to an image forming system configured to form an image on paper, and can be disposed in the apparatus body 10.

The apparatus body 10 can define the external appearance of the image forming apparatus, and may also support or hold therein various components of the image forming apparatus.

The paper feeding device 20 can include a cassette 100 configured to store paper P, a pickup roller 21 configured to pick up the paper stored in the cassette 100, and a feed roller 22 configured to feed the paper picked up by the pickup roller 21 to the developer device 40. The pickup roller 21 can be configured to pick up paper from the cassette 100 one at a time, for example.

The cassette 100 can be configured to be detachable from the apparatus body 10. An opening 11 can be provided, for example, at the lower end of the front portion of the apparatus body 10 such that the cassette 100 can be inserted into the apparatus body 10 through the opening 11. According to an embodiment, the length of the apparatus body 10 in the longitudinal direction of the cassette 100 can be less than the length of the cassette 100. Such configuration may allow for a smaller image forming apparatus. With such configuration, a front portion 100*a* of the cassette 100 may protrude beyond the front portion 10*a* of the apparatus body 10. According to an embodiment, the opening 11 of the apparatus body 10 may be made to protrude from the front portion 10*a* of the apparatus body 10 to provide a cover for the portion of the cassette 100 that protrudes out from the front portion 10*a* of the apparatus body 10.

The paper feeding device 20 can include a sensor unit 200 configured to sense whether the cassette 100 is mounted in the apparatus body 10, whether paper is loaded in the cassette 100, and/or whether the paper is disposed or positioned properly in the cassette 100. According to an embodiment, the sensor unit 200 can be configured to sense whether the cassette is mounted in the apparatus body, whether paper is loaded in the cassette, and/or whether the paper is disposed in the cassette by using two sensors. Greater detail regarding the two sensors used in the sensor unit 200 will be provided later.

The developer device 40 can include, for example, four developers 40Y, 40M, 40C, and 40K, each configured to store toner of a different color. For example, developer 40Y can store yellow (Y) toner, developer 40M can store magenta (M) toner, developer 40C can store cyan (C) toner, and developer 40K can store black (K) toner. Each of the developers 40Y, 40M, 40C, and 40K can include a photoconductor 41. The photoconductor 41 includes a surface on which an electrostatic latent image can be formed by the respective associated one of the light scanning devices 30. Each light scanning device 30 can be configured to irradiate a light beam on the photoconductor 41 of the developer associated with that light scanning device 30. The light produced by the light scanning device 30 can be irradiated in accordance with a printing signal, and can have image information representing one of yellow (Y), magenta (M), cyan (C), or black (K) portions of an image.

Each of the developers 40Y, 40M, 40C, and 40K can include a charge roller 42 configured to charge the photoconductor 41 associated with that developer, a developer roller 43 configured to supply toner to the electrostatic latent image formed on the associated photoconductor 41, and a supply roller 44 configured to supply toner to the developer roller 43.

The transfer device 50 can be configured to transfer toner images developed on the various photoconductors 41 to a sheet of paper. The transfer device 50 can include a transfer belt 51 configured to circulate while in contact with the photoconductors 41, a transfer belt drive roller 52 configured to drive the transfer belt 51, a tension roller 53 configured to support the transfer belt 51 such that the transfer belt 51 maintains a predetermined tension, and transfer rollers 54 configured to transfer the toner images developed on the photoconductors 41 to the paper. While, in this example, the transfer device 50 is shown to include four transfer rollers 54; more or fewer transfer rollers 54 can be used.

The fusing device 60 can be configured to fuse the toner images to the paper after the toner images have been transferred to the paper by the transfer device 50. The fusing device 60 can include a heat roller 61 having a heat source and a press roller 62 configured to press the paper against the heat roller 61. When the paper passes between the heat roller 61 and the press roller 62, the toner images on the paper can be fused to the paper by the heat transmitted from the heat roller 61 and/or by the pressure acting on the paper as it squeezes between the heat roller 61 and the press roller 62.

The paper discharge device 70 can be configured to discharge the printed paper out of the image forming apparatus. The paper discharge device 70 can include a discharge roller 71 and a discharge backup roller 72 disposed to oppose the discharge roller 71.

Figure 2:
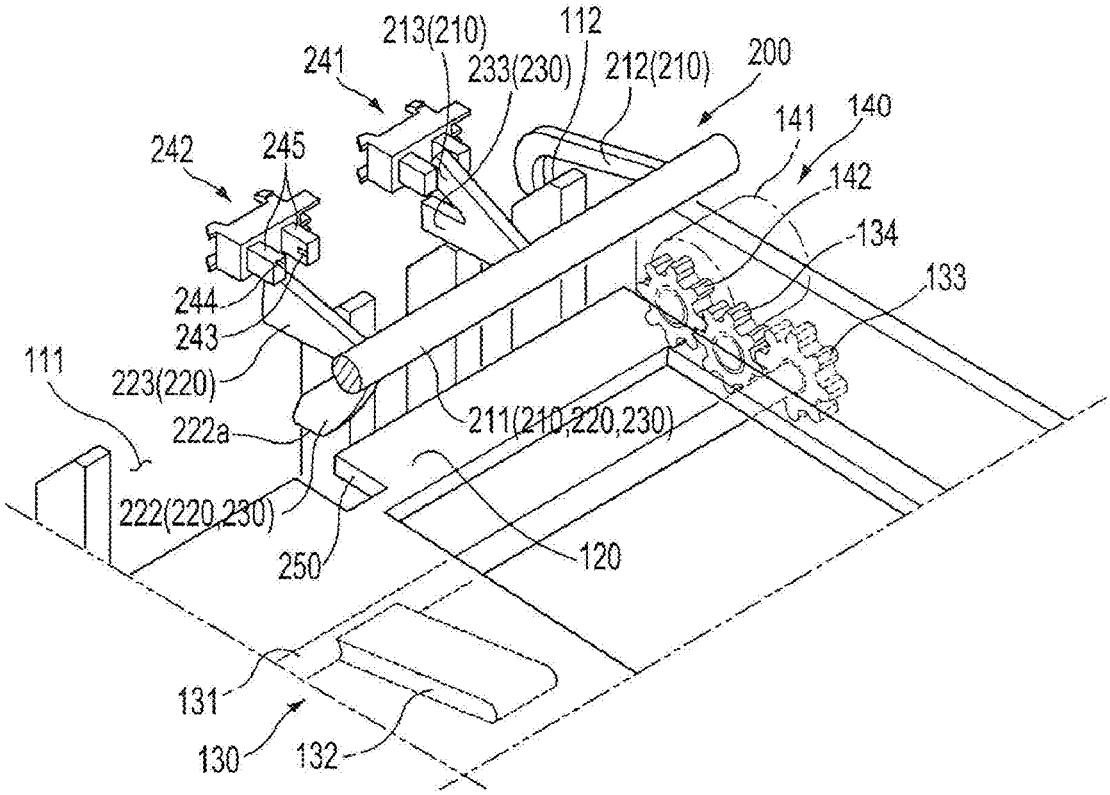
FIG. 2 is a perspective view illustrating portions of a cassette and a sensor unit according to an embodiment of the present disclosure.

FIG. 2 illustrates a cassette and a sensor unit according to an embodiment of the present disclosure.

Referring to FIGS. 1 and 2, the cassette 100 can include a cassette body 110, a loading plate 120 disposed in the cassette body 110, a lifting unit 130 configured to lift the loading plate 120, and a drive unit 140 configured to drive the lifting unit 130.

As shown in FIG. 1, one end of the loading plate 120 can be rotatably coupled to the cassette body 110, via a hinging mechanism, for example, such that the loading plate 120 pivots about that end. In such embodiment, the opposite end of the loading plate 120 not coupled to the cassette body 10 can move up and down.

The lifting unit 130 can include a lifting member 132, a lifting gear 133, and a coupling gear 134. The lifting member 132 can be coupled to a lifting shaft 131, and can be configured to rotate or revolve about a longitudinal axis of the lifting shaft 131. The lifting gear 133 can be disposed at one side of the cassette body 110, and can be configured to rotate the lifting shaft 131 by transferring power to the lifting shaft 131. The coupling gear 134 can be disposed in the cassette body 110, and can be configured to engage with the lifting gear 133. The coupling gear 134 can be coupled to a drive gear 142 of the drive unit 140 such that power can be transferred from the drive unit 140 to the coupling gear 134. The drive gear 142 is described in more detail below.

The drive unit 140 can include the drive gear 142, and a drive motor 141 coupled to the drive gear 142 to rotate the drive gear 142. According to an embodiment, when the cassette 100 is disposed or mounted in the apparatus body 10, the drive gear 142, which may be, for example, provided in the apparatus body 10, can become engaged with the coupling gear 134 of the lifting unit 130 to transfer power to the lifting gear 133 of the lifting unit 130.

FIGS. 3-8 illustrate the operation of the sensor unit in the image forming apparatus according to embodiments of the present disclosure.

As shown in FIGS. 2-8, the sensor unit 200 can include a first actuator 210, a second actuator 220, a third actuator 230, a first sensor 241 and a second sensor 242. In operation, with the sensor 200, there can be an actuating opening 250 defined in the loading plate 120. In the embodiment illustrated in FIG. 2, the first actuator 210, the second actuator 220, and the third actuator 230 are shown as being integrally formed. In other embodiments, however, the first actuator 210, the second actuator 220, and/or the third actuator 230 need not be integrally formed.

According to an embodiment, the first sensor 241 can be configured to sense or detect the first actuator 210 and the third actuator 230 while the second sensor 242 can be configured to sense or detect the second actuator 220. The sensing results can be transmitted to a controller (not shown) of the image forming apparatus. While not shown, it should be readily apparent to those skilled in the art that the image forming apparatus may further comprise a controller that may control the operations of various components of the image forming apparatus, e.g., the paper feeding device 20, the light scanning devices 30, the developer device 40, the transfer device 50, the fusing device 60, and/or the paper discharge device 70, and to control various printing operations of the image forming apparatus, and to implement the various control operations herein described. To this end, according to an embodiment, the control unit may be, e.g., a microprocessor, a microcontroller or the like, that includes a CPU to execute one or more computer instructions to implement the various control operations herein described, and may further include a memory device, e.g., a Random Access Memory (RAM), Read-Only-Memory (ROM), a flesh memory, or the like, to store the one or more computer instructions.

The controller can be configured to control the image forming apparatus based on whether first actuator 210 and/or the third actuator 230 are sensed by the first sensor 241 and whether the second actuator 220 is sensed by the second sensor 242. For example, when the third actuator 230 is sensed by the first sensor 241, and the second actuator 220 is sensed by the second sensor 242, the controller may determine that normal printing can be performed, and may control at least a portion of the image forming apparatus such that a printing operation can commence.

The first sensor 241 and the second sensor 242 can each be implemented using an optical sensor that includes a light emitter 243 and a light receiver 244. The first sensor 241 and the second sensor 242 can each include two supports 245 disposed to oppose each other and to be spaced apart from each other by a predetermined distance. Each of the light emitter 243 and the light receiver 244 can be disposed in one the two supports 245. A first sensing portion 246 can correspond to a space defined between the light emitter 243 and the light receiver 244 of the first sensor 241. A second sensing portion 247 can correspond to a space defined between the light emitter 243 and the light receiver 244 of the second sensor 242. FIGS. 3-8 illustrate examples of the first sensing portion 246 and the second sensing portion 247.

While in one or more of the embodiments described above an optical sensor are used to implement the first sensor 241 and the second sensor 242, other different kinds of sensors however can be used when such sensors can be configured to sense or detect the positions of the first actuator 210, the second actuator 220, and/or the third actuator 230, for example.

The first actuator 210 can be used to detect whether the cassette 100 is mounted in the apparatus body 10.

The first actuator 210 can be rotatably coupled to a frame (not shown) or other component disposed in the apparatus body 10, for example. The first actuator 210 can include a rotary shaft 211, a first actuating arm 212 configured to extend outwardly along the radial direction from the rotary shaft 211 and in a downward direction toward the cassette 100, and a first sensing arm 213 configured to extend along a radial direction from the rotary shaft 211 and in a direction toward the first sensor 241. A downward rotating force can be applied to the first actuating arm 212 and to the first sensing arm 213 from their own weight. When no external force is applied to the first actuating arm 212, both the first actuating arm 212 and the first sensing arm 213 may rotate in a downward direction, which is shown as the counterclockwise direction in FIG. 6.

One end of the first actuating arm 212 can be configured to make contact with the cassette 100 when the cassette 100 is mounted in the apparatus body 10. At the front end portion of the cassette body 110 is disposed a protrusion 112 that is configured to interact with the first actuating arm 212 of the first actuator 210. When the first actuating arm 212 interacts with the protrusion 112 of the cassette 100, with the result being that the first actuating arm 212 is rotated in an upward direction, the first sensing arm 213 also rotates in the upward direction such that the first sensing arm 213 is located in the space defined by the first sensing portion 246 of the first sensor 241 (see FIG. 3).

The second actuator 220 can be used to sense or detect whether paper is loaded in the cassette 100. The second actuator 220 can be rotatably coupled to the frame (not shown) or other component disposed in the apparatus body 10. The second actuator 220 can be coupled to the rotary shaft 211 of the first actuator 210. The second actuator 220 can include the rotary shaft 211, a second actuating arm 222 extending along the radial direction from the rotary shaft 211 and in a downward direction toward the paper P loaded in the cassette 100, and a second sensing arm 223 configured to extend along the radial direction from the rotary shaft 211 and in a direction toward the second sensor 242.

One end of the second actuator 220 includes a print media contact portion 222*a*. When the lifting member 132 is raised, the print media contact portion 222*a* may come into contact with the paper P loaded on the loading plate 120 to rotate the second actuating arm 222 in an upward direction. As a result, the second sensing arm 223 also rotates in an upward direction to be located in the space defined by the second sensing portion 247 of the second sensor 242 (see FIG. 4).

An opening 111 can be formed at the front end of the cassette body 110 such that the cassette body 110 does not interfere with the second actuator 220 when cassette 100 is being mounted in the apparatus body 10 or when the cassette 100 is being taken out from the apparatus body 10.

The third actuator 230 can be used to sense or detect the position of the paper P loaded in the cassette 100. As the loading plate 120 moves up or down, the position of the paper P changes. The third actuator 230 can be used to sense whether the paper P is located at a position such that the printing operation may be possible.

The third actuator 230 can be rotatably coupled to the frame (not shown) or other component disposed in the apparatus body 10. The third actuator 230 can be coupled to the rotary shaft 211 of the first actuator 210 and/or the second actuator 220. The third actuator 230 can include the rotary shaft 211, the second actuating arm 222 described above, and a third sensing arm 233 configured to extend along the radial direction from the rotary shaft 211 and in a direction toward the first sensor 241. According to an embodiment, the third actuator 230 may be configured to share the second actuating arm 222 with the second actuator 220.

When the lifting member 132 is raised, the print media contact portion 222*a* of the second actuating arm 222 comes into contact with the paper P loaded on the loading plate 120, and the second actuating arm 222 rotates in an upward direction. As a result, the third sensing arm 233 also rotates in an upward direction to the space defined by the first sensing portion 246 of the first sensor 241 (see FIG. 5).

The first sensing arm 213 and the third sensing arm 233 can be coupled to the rotary shaft 211 at substantially the same location such that the first sensing arm 213 and the third sensing arm 233 can be sensed or detected using a single sensor, which in this example is the first sensor 241. According to an embodiment, the first sensing arm 213 may be located above the third sensing arm 233. In other embodiments, however, the third sensing arm 233 can be placed above the first sensing arm 213.

The second sensing arm 223 can be offset from the position in which the first sensing arm 213 and the third sensing arm 233 are coupled to the rotary shaft 211 by a predetermined distance along the length of the rotary shaft 211 such that the second sensing arm 223 can be sensed by the second sensor 242.

As shown in the embodiments illustrated in FIGS. 3-8, the radial direction in which the second sensing arm 223 extends from the rotary shaft 211 is such that the second sensing arm 223 can overlap the gap between the first sensing arm 213 and the third sensing arm 233, and can also overlap a small portion of the first sensing arm 213. For example, when the first sensing arm 213 of the first actuator 210 is rotated, and is no longer positioned within the space defined by the first sensing portion 246 of the first sensor 241, the second sensing arm 223 of the second actuator 220 can be positioned to cover the space defined by the second sensing portion 247 of the second sensor 242 (see FIG. 4).

In the embodiments illustrated in FIGS. 3-8, the second sensing arm 223 can overlap a substantial portion of the third sensing arm 233 of the third actuator 230. For example, when the third sensing arm 233 is rotated such that the third sensing arm 233 covers the space defined by the first sensing portion 246 of the first sensor 241, the second sensing arm 223 can cover the space defined by the second sensing portion 247 of the second sensor 242 (see FIG. 5).

Reference numeral 12 of FIGS. 3-8 corresponds to a paper feeding guide disposed in the apparatus body 10. The paper feeding guide 12 can be used to guide paper that is picked up by the pickup roller 21 when being moved or transported to the developer device 40 during printing.

Hereinafter, the operation of the sensor unit 200 of the image forming apparatus according to an embodiment of the present disclosure will be described with reference to FIGS. 2-8.

Figure 3:
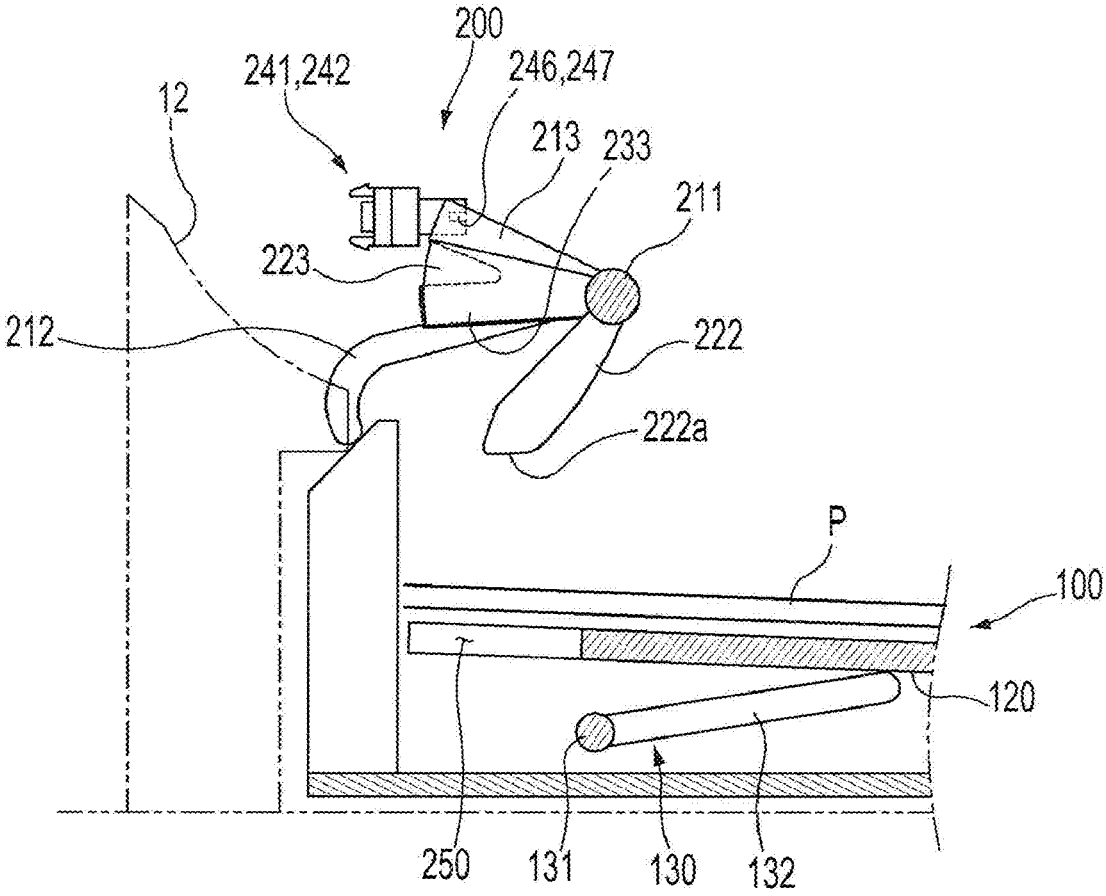
FIG. 3 illustrates the sensor unit in a state in which the cassette is mounted in an apparatus body.
Figure 4:
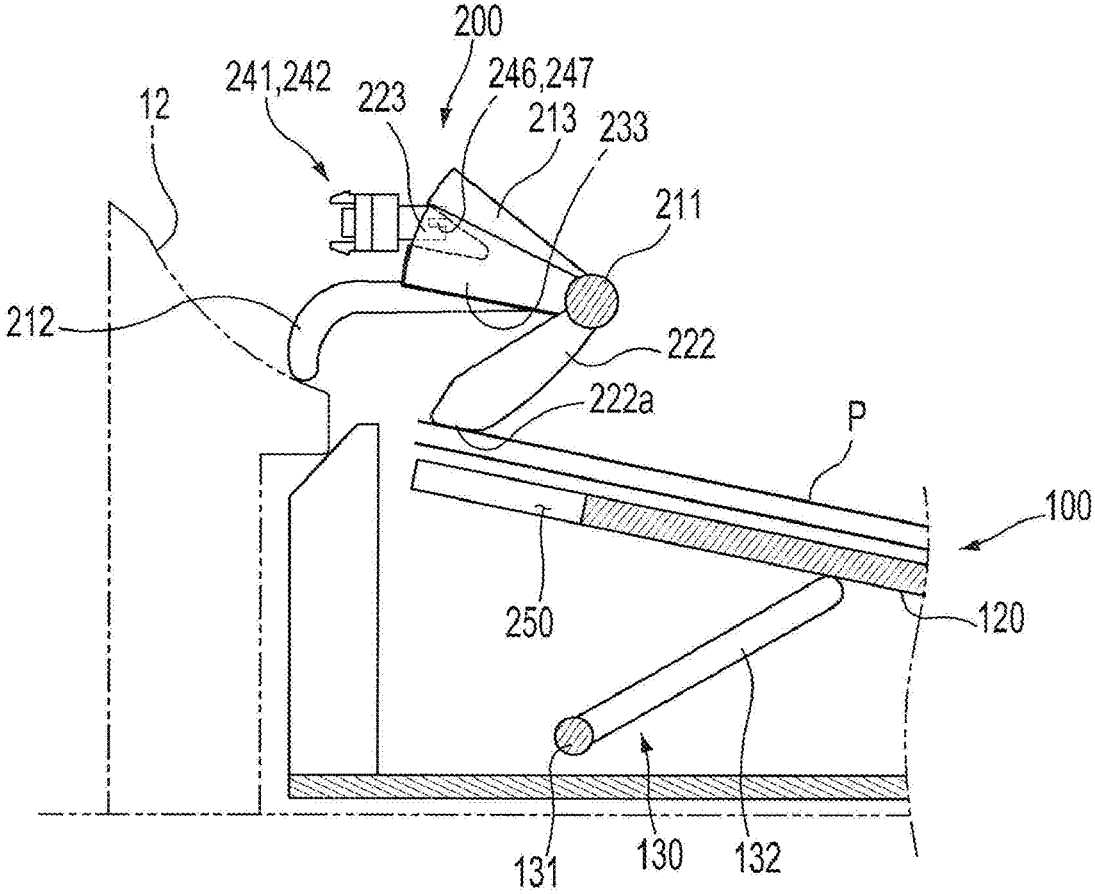
FIGS. 4 and 5 illustrate a second actuating arm in contact with paper.
Figure 5:
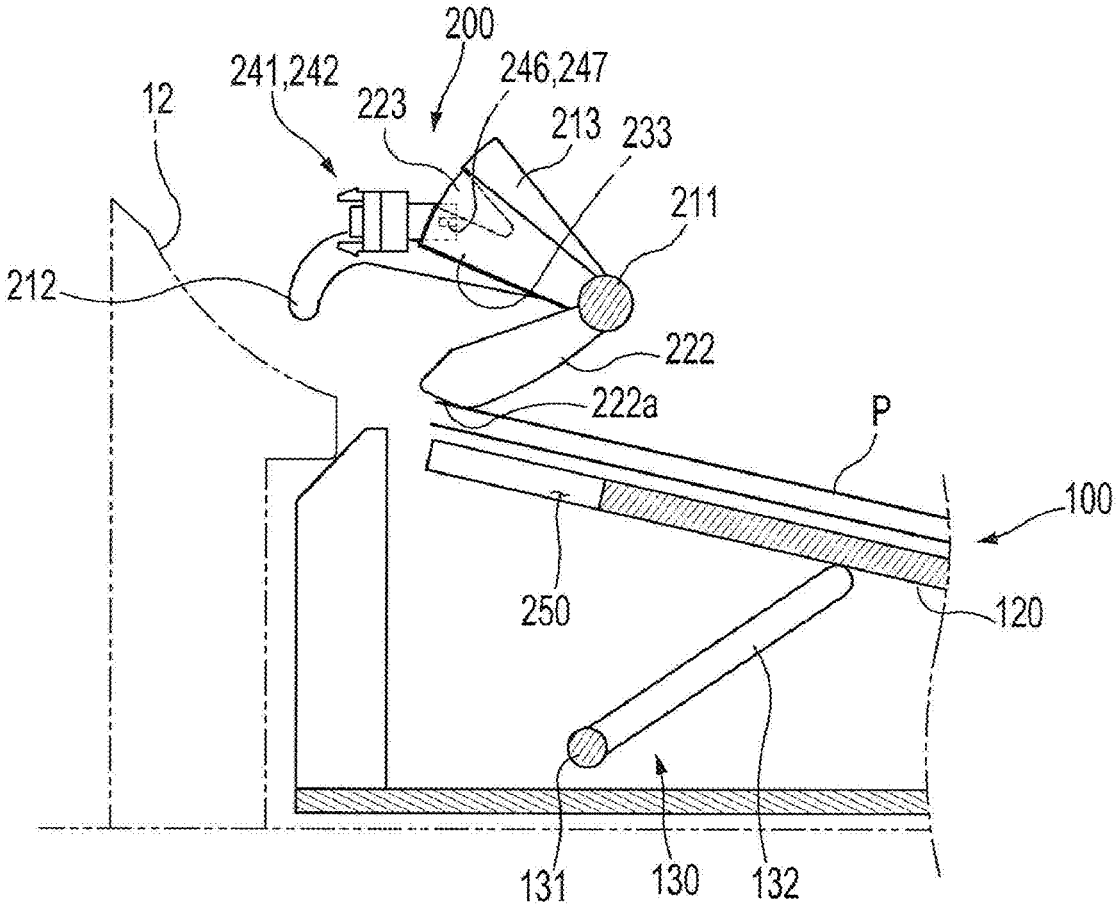
Figure 6:
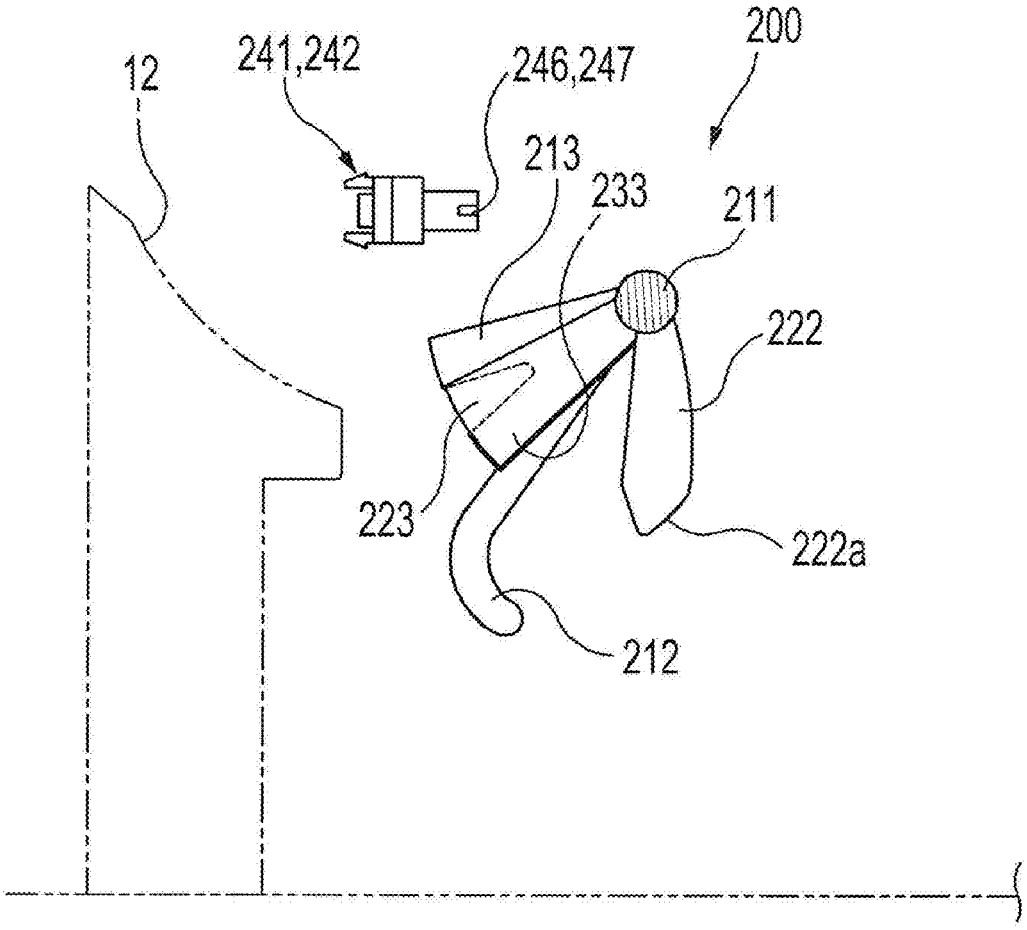
FIG. 6 illustrates a state in which the cassette is not mounted in the apparatus body.
Figure 7:
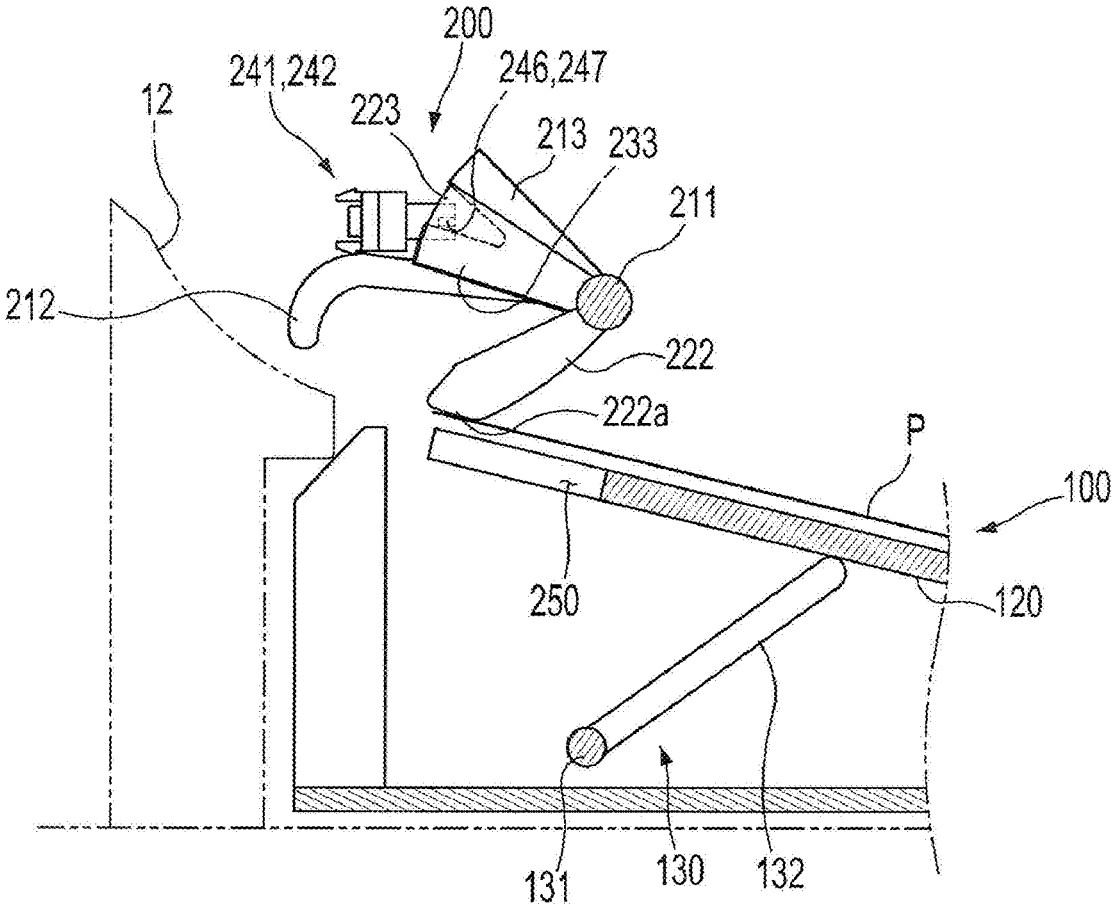
FIG. 7 illustrates a state in which the amount of paper decreases during printing.
Figure 8:
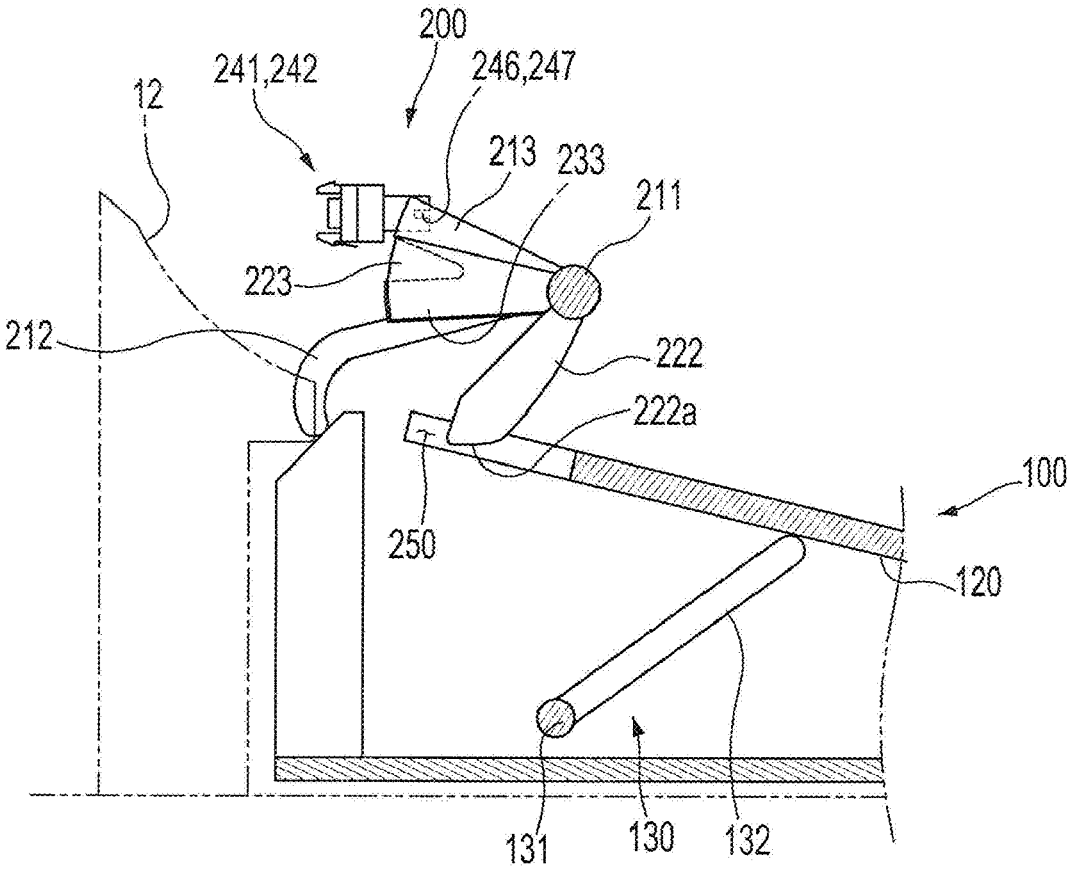
FIG. 8 illustrates a state in which no paper is loaded in the cassette.

FIG. 2 illustrates a perspective view of an instance in which the cassette 100 is mounted in the apparatus body 10 of the image forming apparatus. FIG. 3 is a sectional view of the sensor unit 200 when the cassette 100 is mounted in the apparatus body 10. FIGS. 4 and 5 are each sectional views illustrating the second actuating arm 222 in contact with paper P. FIG. 6 is a sectional view illustrating an instance in which the cassette 100 is not mounted in the apparatus body 10. FIG. 7 is a sectional view illustrating an instance in which the amount of paper P decreases during printing. FIG. 8 is a sectional view illustrating an instance in which the cassette 100 is empty.

Referring to the example shown in FIG. 6 in which the cassette 100 is not mounted in the apparatus body 10, the first actuator 210, the second actuator 220, and the third actuator 230 can freely rotate in a downward direction because of their own weight. In this example, the first sensing arm 213, the second sensing arm 223, and the third sensing arm 233 may also rotate in a downward direction because of their own weight. As a result, none of the first sensing arm 213, the second sensing arm 223, and the third sensing arm 233 is positioned in either the space defined by the first sensing portion 246 of the first sensor 241 or the space defined by the second sensing portion 247 of the second sensor 242. Thus, when the cassette 100 is not mounted in the apparatus body 10, both the first sensor 241 and the second sensor 242 are in a non-sensing state, and may each output a low signal (L). In such a state, the controller of the image forming apparatus can determine that normal printing operations may not be possible.

In the example shown in FIG. 3, in which the cassette 100 is mounted in the apparatus body 10, one end of the first actuating arm 212 contacts the front end of the cassette body 110 and the first actuating arm 212 rotates in an upward direction. As a result, the first sensing arm 213 also rotates in an upward direction and covers the space defined by the first sensing portion 246 of the first sensor 241. In this example, the second sensing arm 223 also rotates in an upward direction but does not cover the space defined by the second sensing portion 247 of the second sensor 242. Moreover, the third sensing arm 233 also rotates in an upward direction but does not cover the space defined by the first sensing portion 246 of the first sensor 241.

In another example, when the second sensor 242 is in a non-sensing state L, as described above, and the first sensor 241 is in a sensing state, and may output a high signal (H), based on the reception of which, the controller may control the lifting member 132 such that the loading plate 120 is raised by the lifting member 132.

By raising the loading plate 120, as shown in FIG. 4, the print media contact portion 222*a* can come into contact with the paper P. When such a contact occurs, both the second actuating arm 222 and the second sensing arm 223 rotate in an upward direction, and the second sensing arm 223 covers the space defined by the second sensing portion 247 of the second sensor 242. In this example, the first sensing arm 213 also rotates in an upward direction and such rotation moves the first sensing arm 213 out of the space defined by the first sensing portion 246 of the first sensor 241. The third sensing arm 233 also rotates in an upward direction, however, the third sensing arm 233 does not cover the space defined by the first sensing portion 246 of the first sensor 241.

In another example, when the second sensor 242 is in the sensing state (i.e., output H), as described above, and the first sensor 241 is in the non-sensing state (i.e., output L), the controller may control the lifting member 132 such that the loading plate 120 is raised by the lifting member 132.

As shown in FIG. 5, the second actuating arm 222 continues to rotate in the upward direction with the continuous rise of the loading plate 120. In this example, the third sensing arm 233 also rotates and covers the space defined by the first sensing portion 246 of the first sensor 241 and the first sensing arm 213 moves out from the space defined by the first sensing portion 246 of the first sensor 241. The second sensing arm 223 also rotates in the upward direction but continues to cover the second sensing portion 247 of the second sensor 242.

When both the first sensor 241 and the second sensor 242 are in the sensing state (i.e., each output H), as described above, the controller may control the lifting member 132 such that the lifting member 132 is stopped and the loading plate 120 is not raised by the lifting member 132. In this example, the controller may determine that the cassette 100 mounting state, the paper P loading state, and the position of the paper P are normal, and the controller, based on a command provided by a user, can start the printing operation.

As the printing is performed, the amount of paper P loaded in the cassette 100 is reduced. When a predetermined amount of the paper P has been reduced, as shown in FIG. 7, the second actuating arm 222 in contact with the paper P may rotate in a downward direction because to its own weight. Moreover, the third sensing arm 233 also rotates in the downward direction and moves out of the space defined by first sensing portion 246 of the first sensor 241. In this example, while the first sensing arm 213 also rotates in the downward direction, the first sensing arm 213 does not cover the space defined by the first sensing portion 246 of the first sensor 241. The second sensing arm 223 also rotates in the downward direction and continues to cover the second sensing portion 247 of the second sensor 242.

With a reduced amount of paper P loaded in the cassette 100, as described above, the first sensor 241 is in the non-sensing state and the second sensor 242 is in the sensing state. These states are substantially the same as the sensing states of the first sensor 241 and the second sensor 242 described with respect to FIG. 4. As a result, the controller may control the lifting member 132 such that the loading plate 120 is raised by the lifting member 132.

By raising the loading plate 120, as shown in FIG. 5, the third sensing arm 233 rotates in an upward direction and covers the space defined by the first sensing portion 246 of the first sensor 241. The first sensing arm 213 rotates in an upward direction but remains out of the space defined by the first sensing portion 246 of the first sensor 241. The second sensing arm 223 rotates in an upward direction and continues to cover the second sensing portion 247 of the second sensor 242.

When both the first sensor 241 and the second sensor 242 are in the sensing state, as described above, the controller may control the lifting member 132 such that the lifting member 132 is stopped and the loading plate 120 is not raised by the lifting member 132. In this example, the controller recognizes or determines that the cassette 100 mounting state, the paper P loading state, and the position of the paper P are normal, and controls the printing operation to continue. The printing operation can be performed repeatedly by having the controller recognize the sensing states of the first sensor 241 and the second sensor 242 as shown in, for example, FIGS. 3, 4, 5, and 7.

When the paper P is consumed during printing such that no paper remains loaded in the cassette 100, as shown in FIG. 8, the print media contact portion 222*a* can be inserted into the actuating hole 250 of the loading plate 120. As a result, the second actuating arm 222 rotates in a downward direction because of its own weight and the first actuating arm 212 also rotates in a downward direction and contacts the cassette body 110. In this example, the first sensing arm 213 rotates in a downward direction and covers the space defined by the first sensing portion 246 of the first sensor 241. The second sensing arm 223 rotates in a downward direction and moves out of the space defined by the second sensing portion 247 of the second sensor 242. The third sensing arm 233 also rotates in a downward direction and moves out from the space defined by the first sensing portion 246 of the first sensor 241. As a result, the controller of the image forming apparatus recognizes that normal printing is not to occur in such an instance.

When a user inserts an empty cassette 100 into the apparatus body 10, as shown in FIG. 3, the first sensing arm 213 covers the space defined by the first sensing portion 246 of the first sensor 241, the second sensing arm 223 moves out from the space defined by the second sensing portion 247 of the second sensor 242, and the third sensing arm 233 moves out from the space defined by the first sensing portion 246 of the first sensor 241.

When the first sensor 241 is in the sensing state while the second sensor 242 is in the non-sensing state, as described above, the controller may control the lifting member 132 such that the lifting member 132 raises the loading plate 120.

Although the loading plate 120 can continue to rise for a predetermined time interval, the print media contact portion 222*a* is inserted into the actuating hole 250 of the loading plate 120, as shown in FIG. 8, as no paper is loaded in the cassette 100. In such an instance, the second actuating arm 222 cannot rotate in an upward direction. Thus, the sensing states of the first sensor 241 and the second sensor 242 do not change for the duration of the predetermined time interval.

When the sensing states of the first sensor 241 and the second sensor 242, as shown in FIG. 3, remain the same for the predetermined time interval, the controller may recognize or determine that normal printing may not be possible in the present state and may stop the loading plate 120 from rising by controlling the lifting member 132.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus, comprising: an apparatus body; a cassette configured to be detachably mounted in the apparatus body and to hold print media; and a sensor unit including a first actuator, a second actuator, a third actuator, a first sensor and a second sensor, the first actuator being configured to indicate whether the cassette is mounted in the apparatus body, the second actuator being configured to indicate whether print media is loaded in the cassette, and the third actuator being configured to indicate a position of the print media, the first sensor being configured to detect the first actuator and the third actuator, the second sensor being configured to detect the second actuator, wherein the second actuator includes a second actuating arm and a second sensing arm, the second actuating arm being configured to contact the print media, the second sensing arm being configured to be detected by the second sensor when the second actuating arm is in contact with a print medium.

2. The image forming apparatus according to claim 1, wherein the first actuator, the second actuator, and the third actuator are integrally formed.

3. The image forming apparatus according to claim 1, wherein the first actuator includes a first actuating arm and a first sensing arm, the first actuating arm is configured to contact the cassette when the cassette is mounted in the apparatus body, the first sensing arm being configured to be detected by the first sensor when first actuating arm comes in contact with the cassette.

4. The image forming apparatus according to claim 1, wherein the third actuator includes the second actuating arm of the second actuator and a third sensing arm, the third sensing arm being configured to be detected by the first sensor if the second actuating arm is in contact with a print medium.

5. The image forming apparatus according to claim 4, wherein, when no external force is applied to the first actuator, the first sensing arm and the third sensing arm are not detected by the first sensor, and the second sensing arm is not detected by the second sensor.

6. The image forming apparatus according to claim 4, wherein, when the cassette is mounted in the apparatus body and the first actuating arm of the first actuator is in contact with the cassette, the first actuator is configured to rotate such that the first sensing arm of the first actuator is detected by the first sensor.

7. The image forming apparatus according to claim 4, wherein: the cassette includes a loading plate configured to hold the print media and a lifting member configured to raise the loading plate, and when the cassette is mounted in the apparatus body, the first sensing arm of the first actuator is detected by the first sensor, and the second sensing arm of the second actuator is not detected by the second sensor, the lifting member of the cassette is operated to raise the loading plate.

8. The image forming apparatus according to claim 7, wherein, when the loading plate is raised by the lifting member of the cassette and the second actuating arm of the second actuator contacts the print media on the loading plate, the first actuator and the second actuator are configured to be rotated such that the first sensing arm of the first actuator is not detected by the first sensor and the second sensing arm of the second actuator is detected by the second sensor.

9. The image forming apparatus according to claim 7, wherein the lifting member of the cassette is stopped when the first actuator, the second actuator, and the third actuator are rotated such that the first sensing arm of the first actuator is not detected by the first sensor, the second sensing arm of the second actuator is detected by the second sensor, the third sensing arm of the third actuator is detected by the first sensor.

10. The image forming apparatus according to claim 4, wherein: the first sensing arm of the first actuator is angularly offset from the third sensing arm of the third actuator, and wherein the second sensing arm of the second actuator is positioned to overlap an angular gap between the first sensing arm of the first actuator and the third sensing arm of the third actuator.

11. The image forming apparatus according to claim 10, wherein the second sensing arm of the second actuator is positioned to overlap a portion of the first sensing arm of the first actuator and a portion of the third sensing arm of the third actuator.

12. The image forming apparatus according to claim 4, wherein: the cassette includes a loading plate defining an actuating hole and a lifting member configured to raise the loading plate, and when the loading plate is raised to a predetermined position by the lifting member, and when no print media is loaded in the cassette, a portion of the second actuator is received in the actuating hole.

13. The image forming apparatus according to claim 12, wherein, when the portion of the second actuating arm is received in the actuating hole, the first sensing arm of the first actuator is detected by the first sensor, the second sensing arm of the second actuator is not detected by the second sensor, and the third sensing arm of the third actuator is not detected by the first sensor.

14. An image forming apparatus, comprising:

an apparatus body;

a cassette detachably mounted in the apparatus body and configured to hold print media;

a first actuator configured to actuate to indicate whether the cassette is mounted in the apparatus body;

a second actuator configured to actuate to indicate whether print media is loaded in the cassette;

a third actuator configured to actuate to indicate a position of the print media in the cassette;

a first sensor configured to detect the first actuator and the third actuator; and a second sensor configured to detect the second actuator, wherein the second actuator includes a second actuating arm and a second sensing arm, the second actuating arm being configured to contact the print media, the second sensing arm being configured to be detected by the second sensor when the second actuating arm is in contact with a print medium.

15. The image forming apparatus according to claim 14, wherein the first actuator, the second actuator, and the third actuator are each coupled to a rotary shaft.

16. The image forming apparatus according to claim 14, wherein: the first actuator includes a first actuating arm and a first sensing arm, the first actuating arm being configured to contact the cassette when the cassette is mounted in the apparatus body, the first sensing arm being configured to be detected by the first sensor, the second actuator includes a second actuating arm and a second sensing arm, the second actuating arm being configured to contact the print media, the second sensing arm being configured to be detected by the second sensor, and the third actuator includes the second actuating arm of the second actuator and a third sensing arm being configured to be detected by the first sensor.

17. The image forming apparatus according to claim 14, wherein the cassette includes a loading plate and a lifting member configured to raise the loading plate, the image forming apparatus further comprising: a controller configured to control the lifting member based on the detection performed by the first sensor or the second sensor, the controller being configured to control the lifting member to be operated when only one of the first and second sensor is in a sensing state.

18. The image forming apparatus according to claim 17, wherein the controller is configured to control the lifting member such that the lifting member is stopped when both the first and second sensors are in the sensing state.

19. The image forming apparatus according to claim 17, wherein the controller is configured to control the lifting member such that the lifting member is stopped when the second sensor remains in the non-sensing state for a predetermined time interval while the first sensor is in the sensing state.

* * * * *